US008136807B2

(12) United States Patent
Uchiyama et al.

(10) Patent No.: US 8,136,807 B2
(45) Date of Patent: Mar. 20, 2012

(54) SHEET ALIGNING APPARATUS

(75) Inventors: Masaaki Uchiyama, Hachioji (JP); Hitoshi Tamura, Hachioji (JP); Hiroyuki Wakabayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 587 days.

(21) Appl. No.: 12/268,803

(22) Filed: Nov. 11, 2008

(65) Prior Publication Data

US 2009/0127773 A1 May 21, 2009

(30) Foreign Application Priority Data

Nov. 15, 2007 (JP) ..... JP2007-296436

(51) Int. Cl.
*B65H 31/34* (2006.01)
*B65H 39/00* (2006.01)

(52) U.S. Cl. ..... 270/58.27; 270/58.11; 270/58.12; 270/58.16; 270/58.17; 271/221

(58) Field of Classification Search ..... 270/58.11, 270/58.12, 58.16, 58.17, 58.27; 271/207, 271/213, 220, 221, 222; 414/791.2
See application file for complete search history.

(56) References Cited

U.S. PATENT DOCUMENTS

| | | | | |
|---|---|---|---|---|
| 6,889,974 | B2 * | 5/2005 | Tamura et al. | 271/220 |
| 7,584,948 | B2 * | 9/2009 | Fujii et al. | 270/58.11 |
| 2009/0243198 | A1 * | 10/2009 | Konishi | 271/221 |
| 2009/0289412 | A1 * | 11/2009 | Tanaka et al. | 271/220 |

* cited by examiner

*Primary Examiner* — Leslie A Nicholson, III
(74) *Attorney, Agent, or Firm* — Finnegan, Henderson, Farabow, Garrett & Dunner, L.L.P.

(57) ABSTRACT

In a sheet aligning apparatus, a pair of sheet aligning members stops at three positions such that when a sheet aligning operation is not conducted, the pair of sheet aligning members is stopped at the first position of an upper level so as not to come in contact with sheets discharged from a discharging section, when the sorting section shifts for sorting, the pair of sheet aligning members is stopped at the second position of a middle level lower than the first position so as not to come in contact with sheets stacked on the tray, and when a sheet aligning operation is conducted, the pair of sheet aligning members is stopped at the third position of a lower level so as to come in contact with the top surface of the tray or the upper surface of the sheets stacked on the tray.

10 Claims, 11 Drawing Sheets

8
5a
LH
5b
3

5b
P
3

5a
P
5b

SHEET ALIGNING APPARATUS

This application is based on Japanese Patent Application No. 2007-296436 filed on Nov. 15, 2007 in Japanese Patent Office, the entire content of which is hereby incorporated by reference.

TECHNICAL FIELD

The present invention relates to a sheet aligning apparatus.

BACKGROUND ART

At the time of bundling plural sheets (referred to "a set of sheets") printed by an image forming apparatus employing an electrophotographying system such as a copying machine and a printing machined and producing plural sets of sheets, it is desirable to stack sheets discharged from a sheet discharging section on a tray so as to be able to sort for each set of sheets.

Here, as a sorting device to sort sheets for each set of sheets (also referred to "a shifting device"), widely employed is a device to shift a tray in a direction perpendicular to the discharging direction of sheets by about 10 to 20 mm and to stack a set of sheets on the tray on the condition each set of sheets is positioned to be out of alignment from other sets of sheets.

Further, as an aligning device to align edge surfaces of each set of sheets, Japanese Patent Unexamined Publication No. 2006-206331 discloses to provide a shifting section to conduct a sorting operation by shifting a tray and a pair of arranging members (sheet aligning members) to conduct an arranging operation (an aligning operation) by sandwiching edge portions of discharged sheets. This patent publication discloses a technique to shift the sheet aligning member to two stop positions in which at the time of shifting the tray, the sheet aligning member is rotated around a supporting shaft being a center of rotation and shifted upward to a retracting position, and at the time of conducting an aligning operation, the sheet aligning member is shifted downward to an aligning position.

However, in the above patent publication, at the time of shifting, after the sheet aligning member was rotated and shifted to the retracting position, the tray is shifted in the shifting direction by a predetermined distance, and then a sorting operation is conducted. At the time of aligning sheets, the sheet aligning member is rotated and shifted downward from the retracting position to the aligning position. Therefore, since it needs a time for shifting upward and downward, there is fear that in the case of a high speed machine, a next sheet is discharged in the middle course that the sheet aligning member is shifting upward or downward, and it is worried that the alignment of sheets becomes poor.

SUMMARY OF THE INVENTION

One aspect of the present invention is as follows.

A sheet aligning apparatus comprises:

a discharging section to discharge sheets;

a tray on which the sheets discharged from the discharging section are stacked;

a sorting section to sort the sheets to be stacked on the tray in a direction perpendicular to the discharging direction of the sheets;

a pair of sheet aligning members to align both edges of the sheets sorted and stacked on the tray, wherein the both edges of sheets are in a direction perpendicular to the conveying direction of the sheets;

a control section to control the pair of sheet aligning members to stop at least three positions in a vertical direction in such a way that:

when a sheet aligning operation is not conducted, the pair of sheet aligning members is stopped at the first position of an upper level so as not to come in contact with sheets discharged from the discharging section, when the sorting section shifts for sorting sheets, the pair of sheet aligning members is stopped at the second position of a middle level lower than the first position so as not to come in contact with sheets stacked on the tray, and when a sheet aligning operation is conducted, the pair of sheet aligning members is stopped at the third position of a lower level so as to come in contact with the top surface of the tray or the upper surface of the sheets stacked on the tray.

BRIEF DESCRIPTION OF THE DRAWING

FIG. 7(*b*) is an illustration showing the situation that a bundle of sheets stacked on the tray is sorted.

FIG. 7(*c*) is an illustration showing the situation that a sheet aligning member is aligning sheets.

FIG. 12(*b*) is an illustration showing the situation that the sheet aligning member locates at the first position P1, the second position P2 and the third position P3 respectively.

DETAILED DESCRIPTION OF THE PREFERRED EMBODIMENT

Hereafter, embodiments of the present invention will be explained. Here, although the present invention will be explained with reference to the embodiments shown in drawings, the present invention is not limited to these embodiments. Further, the assertive explanations in the following embodiments of the present invention show best modes, and do not limit the definition of terminology or the technical scope of the present invention.

(Structure of Sheet Aligning Apparatus)

Figure 1:
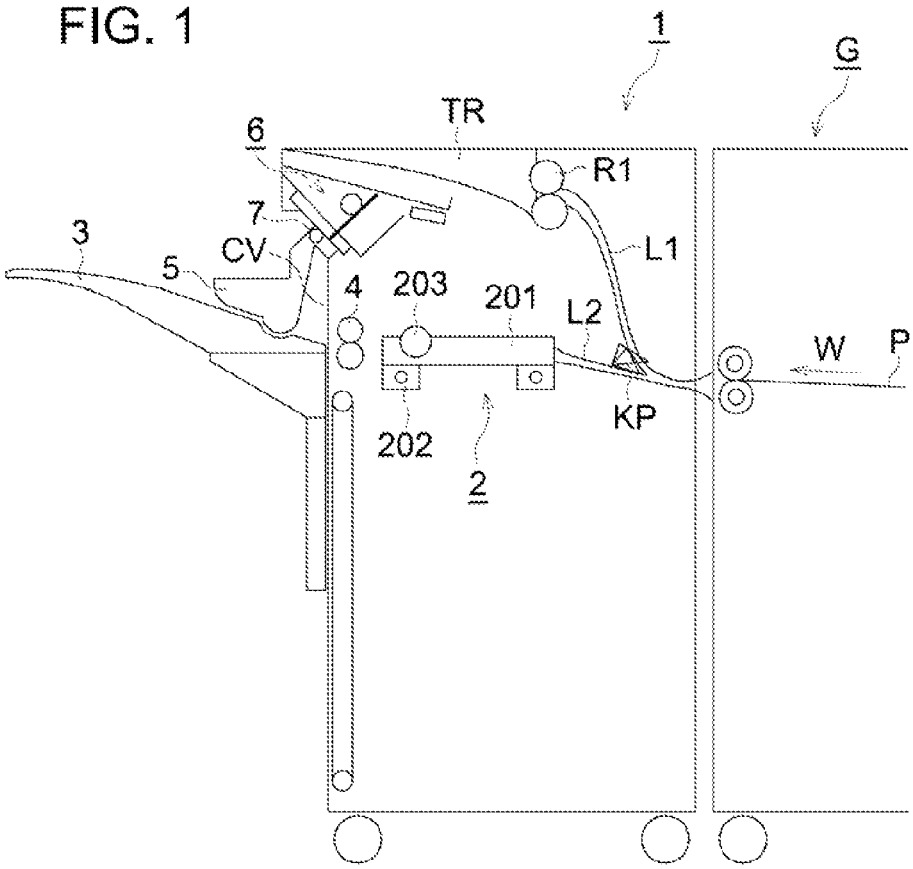
FIG. 1 is an outlined cross sectional view relating to the present embodiment.

FIG. 1 is an outlined sectional view relating to the present embodiments and showing the situation that sheets P discharged from an image forming apparatus are aligned by a sheet aligning apparatus and are stacked on a tray. The sheets P discharged in the direction of an arrow W from an image forming apparatus G are conveyed into a sheet aligning apparatus 1 and proceed to one of conveyance routes L1 and L2 by a sheet conveyance switching section KP to switch over the conveyance route of sheets. The switch-over of the sheet conveyance switching section KP is performed by an operation of a user from an un-illustrated operating section.

Sheets P having proceeded to the conveyance route L1 are stacked sequentially on a discharged-sheet tray TR by the conveying force of a sheet discharging roller section R1, and sheets P having proceeded to the conveyance route L2 are conveyed to a sorting section 2 to shift the sheets into the direction perpendicular to the conveying direction by a predetermined distance (in the present embodiments: 15 mm). The sheets P having passed the sorting section 2 are discharged onto a tray 3 by a discharging section 4.

Furthermore, the sheet aligning apparatus 1 is equipped with a pair of sheet aligning members 5 to arrange both side-planes of the sheets P on the tray 3 in the direction perpendicular to the conveying direction of the sheets P in conjunction with the back and forth movement of the sorting section 2 on the predetermined distance and a rotation driving section 6 to rotate the pair of sheet aligning members 5 in a vertical direction. Here, among the pair of sheet aligning members 5, a sheet aligning member located at the right side in a view looking from the tray 3 (the front side of the sheet aligning apparatus 1) is marked with 5*a* and a sheet aligning member located at the left side is marked with 5*b*.

(Sorting Section)

Figure 2:
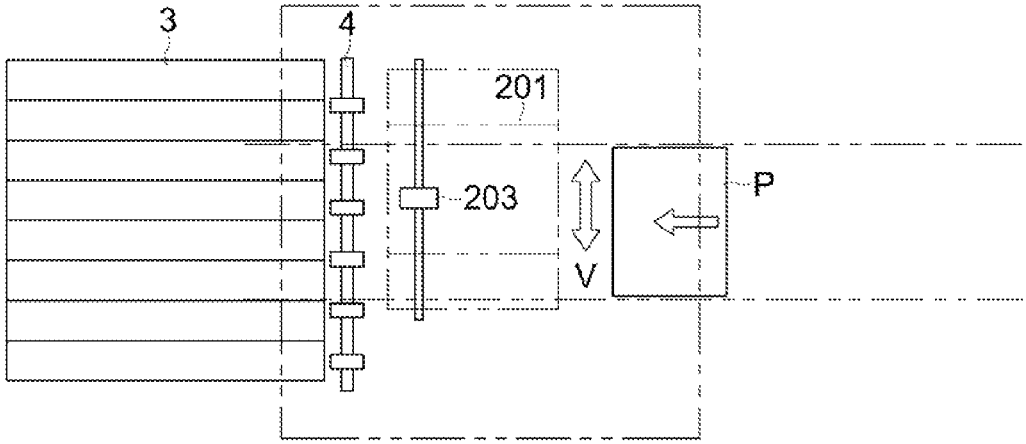
FIG. 2 is a top view showing the situation that a sorting box 201 is shifted outward and homeward between a predetermined distance in the direction of an arrow V by a sort driving section 202.

The present embodiments employ a structure to provide a sorting box 201 into which the sheets P conveyed from the conveyance route L2 to the sorting section 2 are put one by one, and a technique to discharge them from the sorting box 201 onto the ray 3 by the discharging section 4 after a sort driving section 202 have sorted them. FIG. 2 is a top view showing the situation that the sorting box 201 is shifted outward and homeward between the predetermined distance in the direction of an arrow V by the sort driving section 202. Conveying rollers 203 to convey sheets P are provided in the sorting box 201, and the sheets P are discharged from the conveying roller 203 onto the tray 3 through the discharging section 4 with a predetermined timing by an un-illustrated control section. The sorting section 2 employing such a sorting box 201 can conduct the sorting without shifting the tray 3.

(Sheet Aligning)

Figure 3:
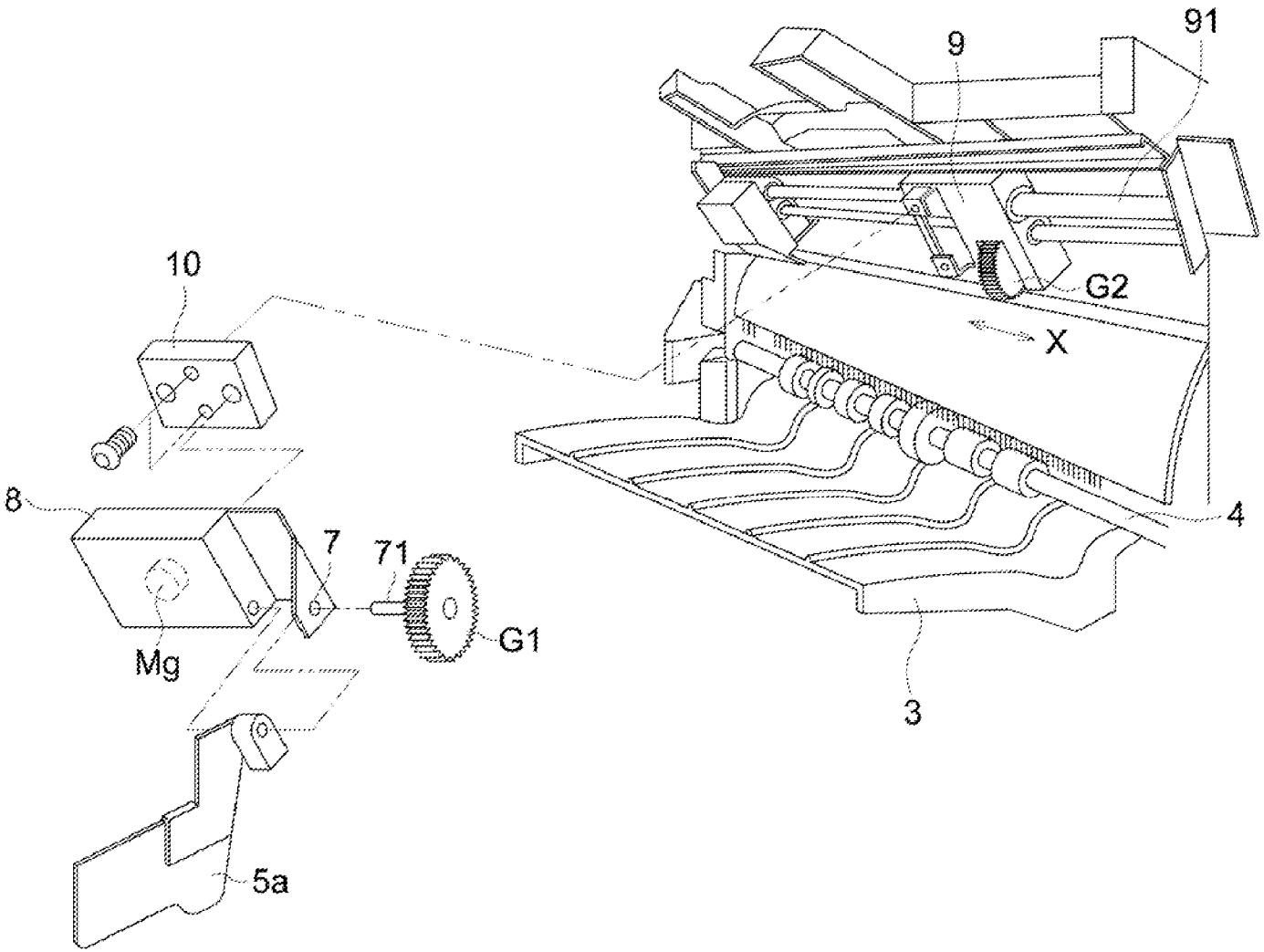
FIG. 3 is a perspective view being looked from a tray 3 side.

Next, a section to align sheets P discharged on the tray is explained with reference to FIGS. 3 to 7. FIG. 3 is a perspective view looked from the tray 3 side, and an outer frame at the tray 3 side is omitted in FIG. 3. although FIG. 3 is explained based on the right-hand side sheet aligning member 5*a*, since the left-hand side sheet aligning member 5*b* has also the same structure as that of the right-hand side sheet aligning member 5*a*, the explanation about it is omitted here.

In FIG. 3, a shaft supporting base 8 having a rotating shaft 71 to rotate the sheet aligning member 5*a* around a rotation center 7 in a vertical direction is attached via a spacer 10 to a sliding stand 9 to shift the sheet aligning member 5*a* in the direction of an arrow X. A gear G1 to rotate the sheet aligning member 5*a* is attached to the end portion of the rotating shaft 71.

Figure 4:
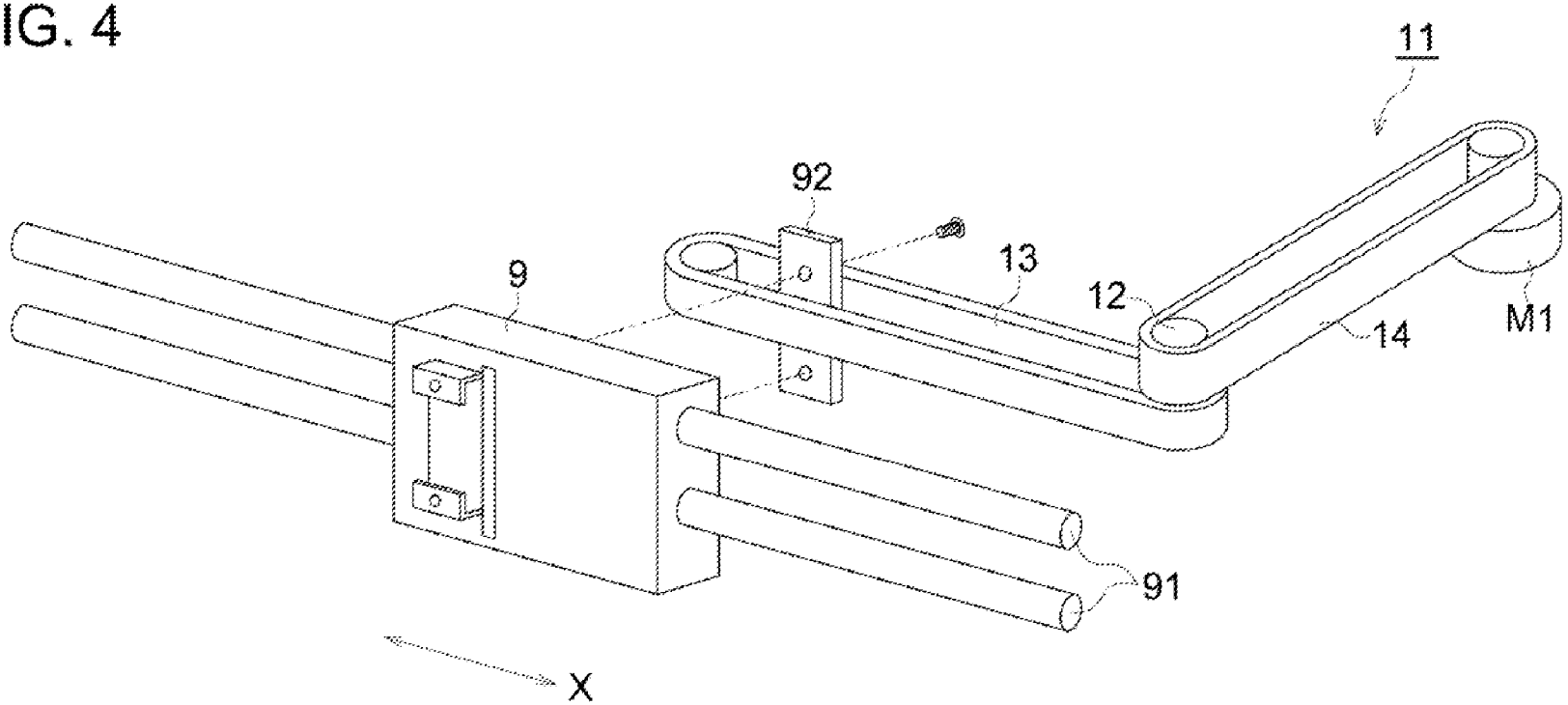
FIG. 4 is an illustration showing the situation that a sliding stand is slid by a slide driving section 11.

As shown in FIG. 4, a slide driving section 11 is structured with a timing belt 13, a timing belt 14 connected with the timing belt 13 through a pulley 12, and a motor M1 to rotate the timing belt 14. The timing belt is fixed to the sliding stand 9 with a fixing member 92 so that the sliding stand can slide in the direction X with the rotational movement of the timing belt 13. Since the timing belt 14 is employed in consideration of space in an apparatus, the timing belt 13 may be driven directly by the motor M1 without the timing belt 14.

(Rotation Driving Section)

Figure 5:
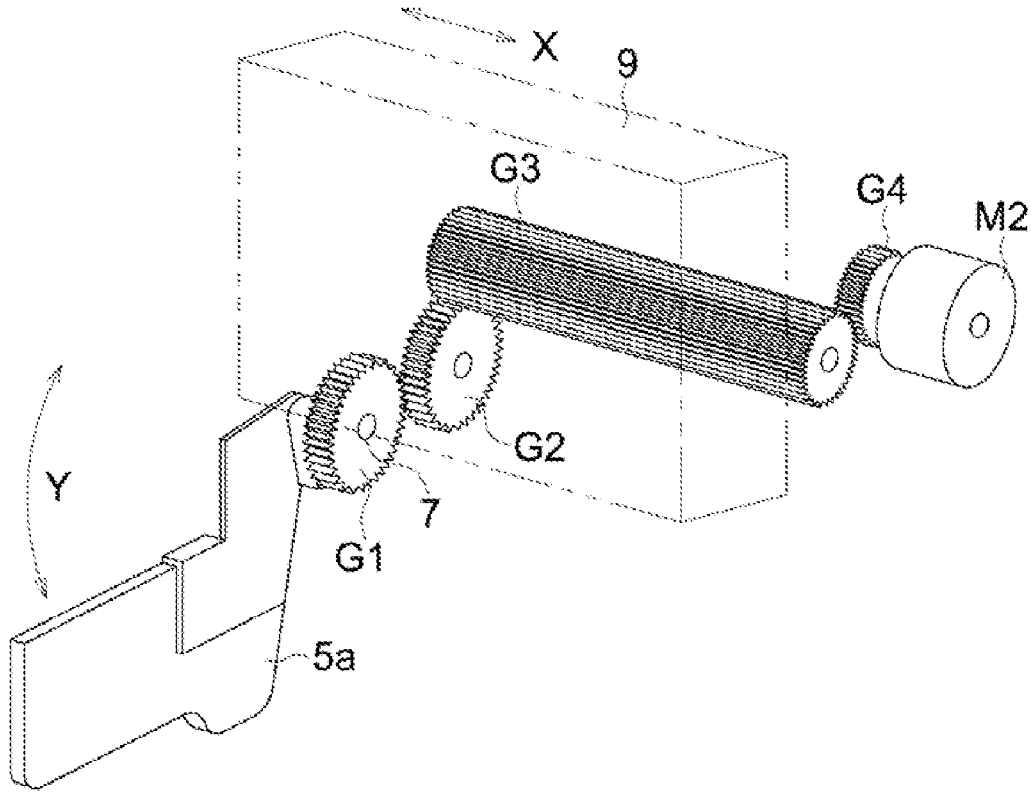
FIG. 5 is a perspective view showing a rotation driving section 6.
Figure 6:
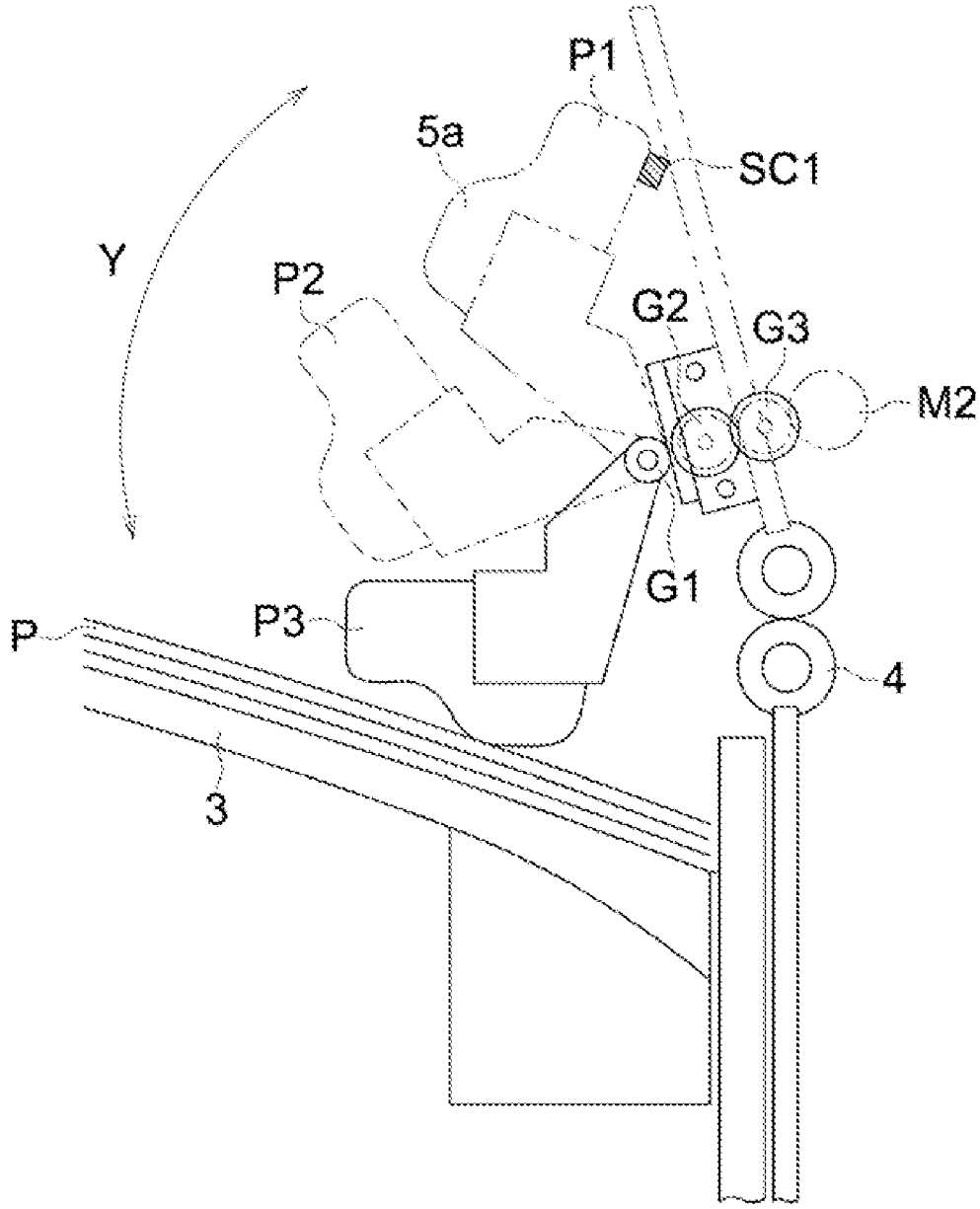
FIG. 6 is a schematic diagram showing the positional relationship of P1, P2, and P3 in an illustration showing the rotating actions of a sheet aligning member.

A rotation driving section 6 to rotate the pair of sheet aligning members 5 in the vertical direction is explained with reference to FIG. 5. The gear G1 attached to the end portion of the rotating shaft 71 engages with a gear G3 via a gear G2. The gear G3 has a gear section with a length corresponding to the distance on which the sorting section shifts in the shifting direction. Further, a gear G4 attached to a motor 2 (a pulse motor used in the present embodiments) engages with the gear G3. When the motor M2 rotates, the sheet aligning member 5*a* rotates in the vertical direction (in a direction Y in FIG. 5).

The sheet aligning member 5*a* is adapted to stop the rotation at least three positions (the sheet aligning member 5*b* is adapted to the same). Here, the first position P1 is a position of an upper level where the sheet aligning members 5*a* and 5*b* do not come in contact with a sheet P discharged from the discharging section 4 and a user takes out sheets on the tray 3 without interference. The second position P2 is a position of a middle level where the sheet aligning members 5*a* and 5*b* do not come in contact with sheets P stacked on the tray 3 when the sorting section 3 shifts by a predetermined distance in order to conduct sorting, and the third position P3 is a position of a lower level where the sheet aligning members 5*a* and 5*b* come in contact with the top surface of the tray 3 or the surface of the uppermost sheet of the sheets stacked on the tray 3, (refer to FIG. 6).

When an operation to align sheets P is not conducted, the sheet aligning members 5*a* and 5*b* are adapted to stop at the first position P1, and when the operation to align sheets P is conducted, the sheet aligning members 5*a* and 5*b* are adapted to stop at the second position P2 and the third position P3. These controls are conducted by a control section to drive a motor M2.

When the motor 2 is a pulse motor, it is possible to detect the first position P1, the second position P2 and the third position P3 respectively by counting the number of pulses. Alternatively, when an ordinary DC motor is used as the motor 2, position detecting sensors are provided at the first position P1, the second position P2 and the third position P3 respectively and a control section may conduct a stop position control by inputting detection signals of the position detecting sensors. In the present embodiments, a detection sensor SC1 is used as a sensor to detect that the sheet aligning members 5*a* and 5*b* are located at the first position P1. When the sheet aligning members 5*a* and 5*b* come in contact with the detection sensor SC1, the detection sensor SC1 transmits a detection signal and the control section controls the motor M2 to stop rotation upon receipt of the detection signal.

(Oscillating Section)

When the operation to aligning sheets P is conducted, one sheet aligning member of the sheet aligning members 5*a* and 5*b* is fixed and anther sheet aligning member oscillates in the direction perpendicular to the conveying direction of sheets P so as to align the sheets P. At every time when sheets P are discharged by the discharging section and stacked on the tray 3, the anther sheet aligning member is shifted by a predetermined distance (5 mm in the present embodiments) so as to conduct the aligning by the use of the slide driving section 11 as the oscillating section. The shifting of the sheet aligning member 5*a* conducts an action to narrow the distance between the pair of sheet aligning members 5 so as to bring them in contact with the sheets P to an extent to slightly push the edge face of the sheets P, and another action to expand the distance after the pair of sheet aligning members 5 has become the condition to sandwich the sheets P. When the pair of sheet aligning members 5 conducts a series of these actions, the edge faces of the sheets P can be aligned.

In this way, by the control to retract the pair of sheet aligning members 5 to the second position at the time of the sorting operation, it becomes possible to shorten the time period until the aligning operation is started, in comparison with the conventional aligning method with two stop position of upper and lower levels.

(Aligning)

Firstly, when sheets P of the predetermined number of sheets (or called as a bundle of sheets) to constitute a set of sheets being a unit in the sorting are discharged, the pair of sheet aligning members 5 is rotated by the rotation driving section 6 and stops at the second position P2 in order to avoid interference with a bundle of sheets having been aligned.

When the second set of sheets are aligned, the pair of sheet aligning members 5 being waiting on the stop condition at the second position P2 is shifted by the slide driving section in conjunction with the shifting of the sorting box 201. Thereafter, the pair of sheet aligning members 5 is rotated downward by the rotation of the motor M2.

Among the pair of sheet aligning members 5 rotated downward, one sheet aligning member comes in contact with the top surface of the preceding sheets having previously discharged onto the tray 3 and another sheet aligning member comes in contact with the tray 3. However, in the case that a bundle of following sheets discharged on the tray 3 is thick, the another sheet aligning member stops on a condition floating from the tray 3 without coming in contact with the tray 3. At this time, the control section controls to fix the sheet aligning member (designated as 5*a*) coming in contact with the sheets having been previously sorted and discharged at the first time and to oscillate the sheet aligning member (designated as 5*b*) not coming in contact with the sheets.

Figure 7:
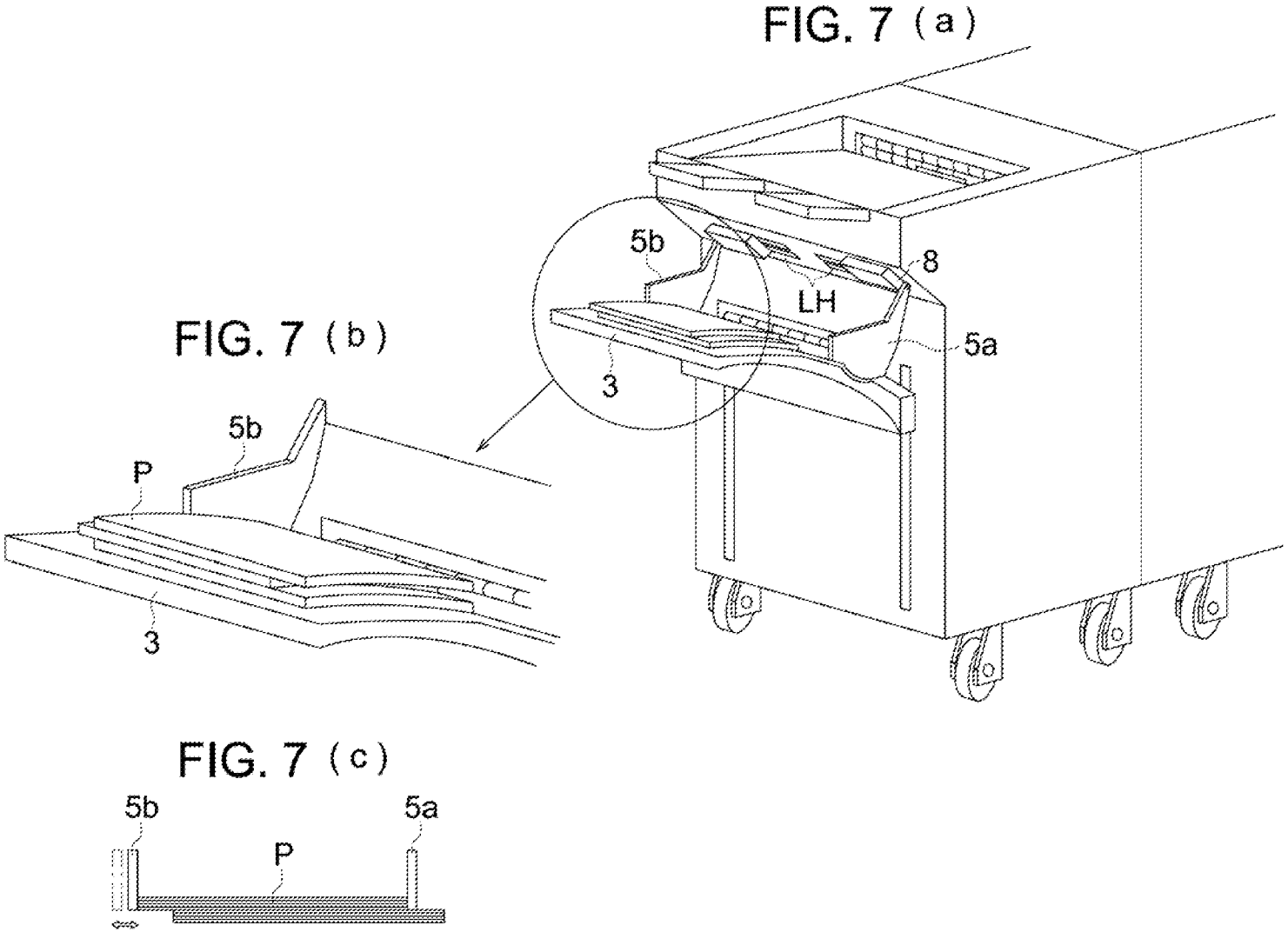
FIG. 7(*a*) is a perspective view showing the tray side of a sheet aligning apparatus 1.

FIG. 7(*a*) shows the condition that several bundles of sheets are sorted and stacked onto the tray 3, and FIG. 7(*b*) is an illustration showing the situation that the tray 3 is expanded. Further, FIG. 7(*c*) is an illustration showing the situation that the second bundle of sheets is being aligned and the sheet aligning member 5*a* comes in contact with the uppermost surface of the first bundle of sheets and is made to the condition (fixed condition) that it is unable to move. In the above situation, the sheet aligning member 5*b* aligns the edge surface of the second bundle of sheets on an oscillating condition.

Next, when the third bundle of sheets is aligned, the sheet aligning member 5*a* is oscillated and the sheet aligning member 5*b* is fixed. In this way, by a process of repeating aligning actions alternately, it is possible to conduct sheet-aligning for plural sets of sheets (plural bundles of sheets).

Further, when plural sets of sheets are stacked on the tray 3, the position of the uppermost surface of sheets becomes gradually not to match with the position of the outlet port of sheets discharged from the discharging section. Then, the tray 3 is shifted downward by a proper distance by a tray hoisting section and a positioning section to determine upward or downward shifting such that the position of the uppermost surface of sheets is controlled to maintain a proper level from the sheet outlet port of the discharging section 4.

(Flowchart)

Figure 8:
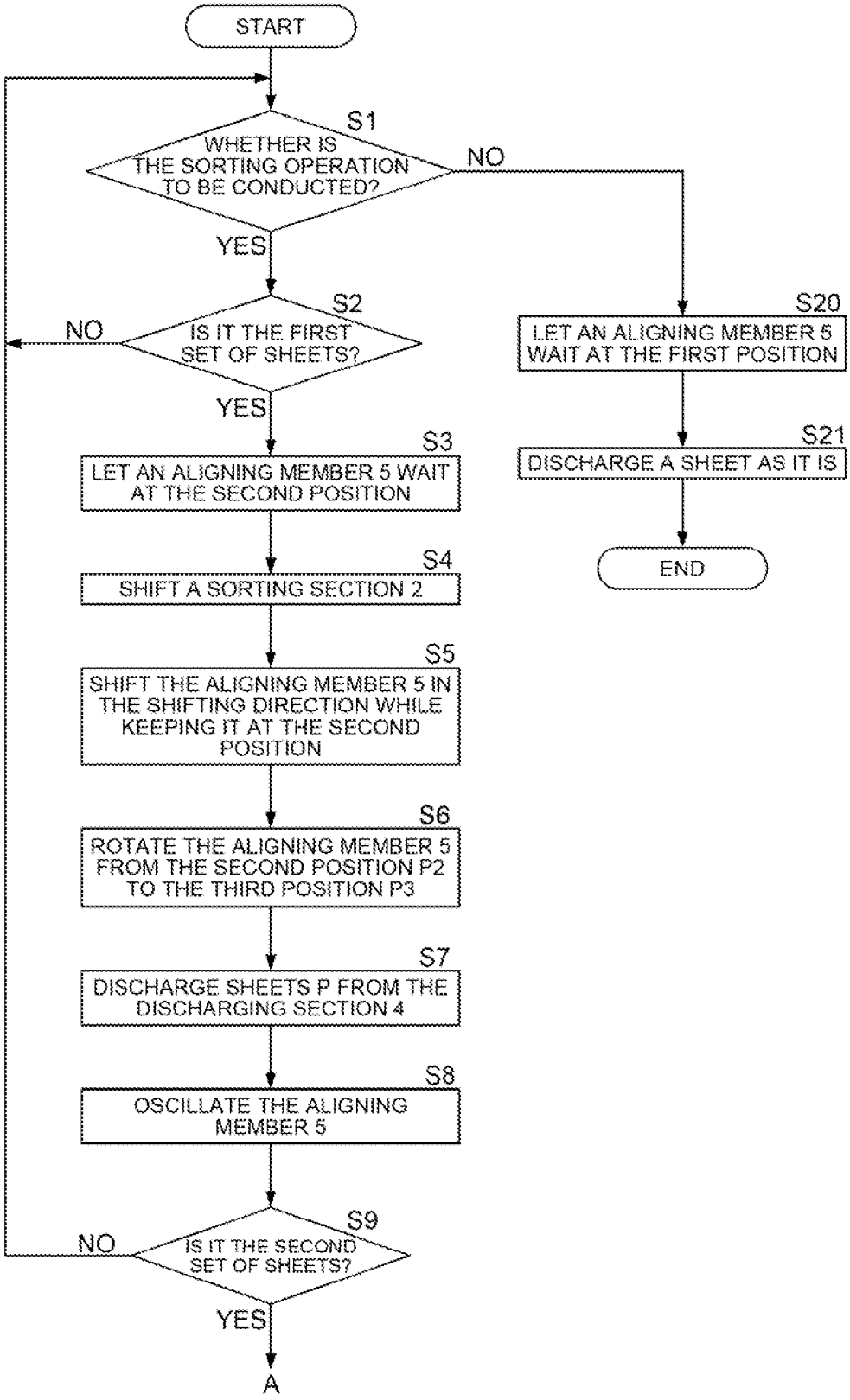
FIG. 8 is a flowchart showing a control in the present embodiment.
Figure 9:
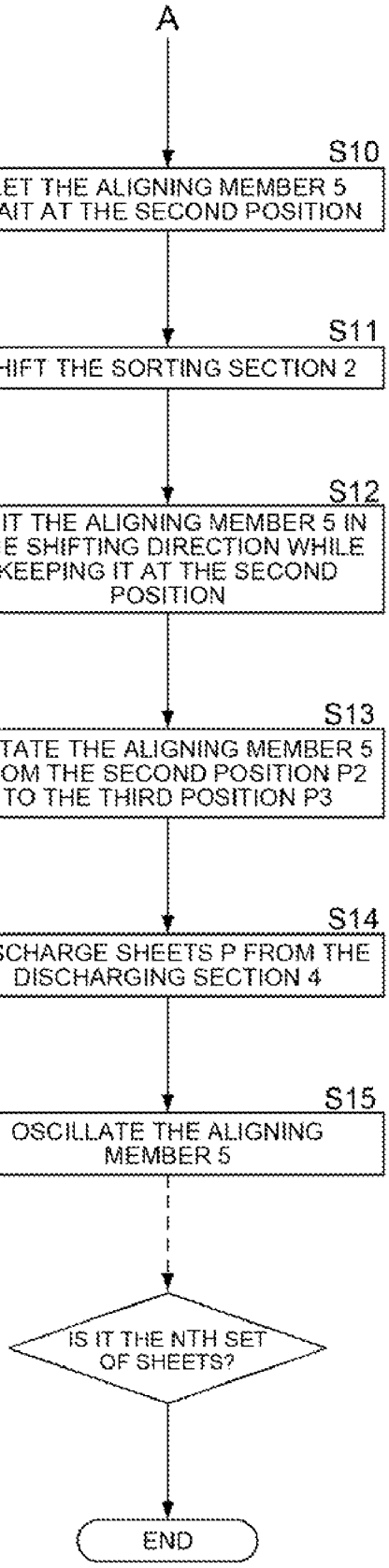
FIG. 9 is a flowchart showing Steps following after Step A in the control in the present embodiment.

FIG. 8 and FIG. 9 are flowcharts showing processing procedures conducted by the control section according to the present embodiments. Here, the sign A represents the destination to step to.

At Step S1, it is judged whether or not the sorting is to be conducted. In the case (S1: Yes) that the sorting is conducted, it is judged whether a set of sheets is the first set (Step S2). When the set of sheets is the first set (S2: Yes), the pair of sheet aligning members 5 is rotated and shifted to the second position P2 and is made to stand by at the position (Step S3), and the sorting section is shifted (Step S4). The pair of sheet aligning members 5 is shifted in conjunction with the operation in the Step S4 on the condition in Step S3 (Step S5). The pair of sheet aligning members 5 is rotated and shifted from the second position P2 to the third position P3 (Step S6), sheets are discharged (Step S7). One (here, the sheet aligning member 5*a*) of the pair of sheet aligning members 5 is oscillated for every time when a sheet is discharged (Step S8).

Next, it is judged whether or not the sorting is to be conducted for the second set of sheets (Step 59), in the case that the judgment result in Step S9 is "Yes", the pair of sheet aligning members 5 is rotated and shifted from the third position P3 to the second position P2 and is made to stand by at the position (Step S10). Then, the sorting section is shifted by a predetermined distance in the counter direction from the position where the first set of sheets were discharged (step 11), and during this period, the pair of sheet aligning members 5 is shifted in conjunction with the operation in Step S11 (Step S12). Next, the pair of sheet aligning members 5 is rotated and shifted from the second position P2 to the third position P3 and the sheet aligning member 5*a* comes in contact and stops (Step S13). Sheets P are discharged from the discharging section 4 (Step S14) and the sheet aligning member 5*b* not being located on the discharged sheets is oscillated (Step S15).

Hereafter, the flows of Step 2 and Step 9 are conducted alternately so as to complete the sorting operation for $n^{th}$ set of sheets.

When the judgment result in Step S1 is "No", the pair of sheet aligning members S is made to stand by at the first position P1 (Step S20), the sheets are discharged as they are (Step S21).

When the judgment results in Step S2 and Step S9 are "No", the operation is returned to Step S1.

(Another Rotation Driving Section)

In the above embodiment, the above rotation driving section employs a gear train in which the gear G1 attached to the end portion of the rotation shaft 71 is adapted to engage with the gear G2 via the gear G2.

As another embodiment, a push-out member 94 to come in contact in a straight line direction with the pair of sheet aligning members 5 and a rotating section to rotate the pair of sheet aligning members 5 in conjunction with the movement of the push-out member 94 will be explained with reference to FIGS. 10 to 12.

Figure 10:
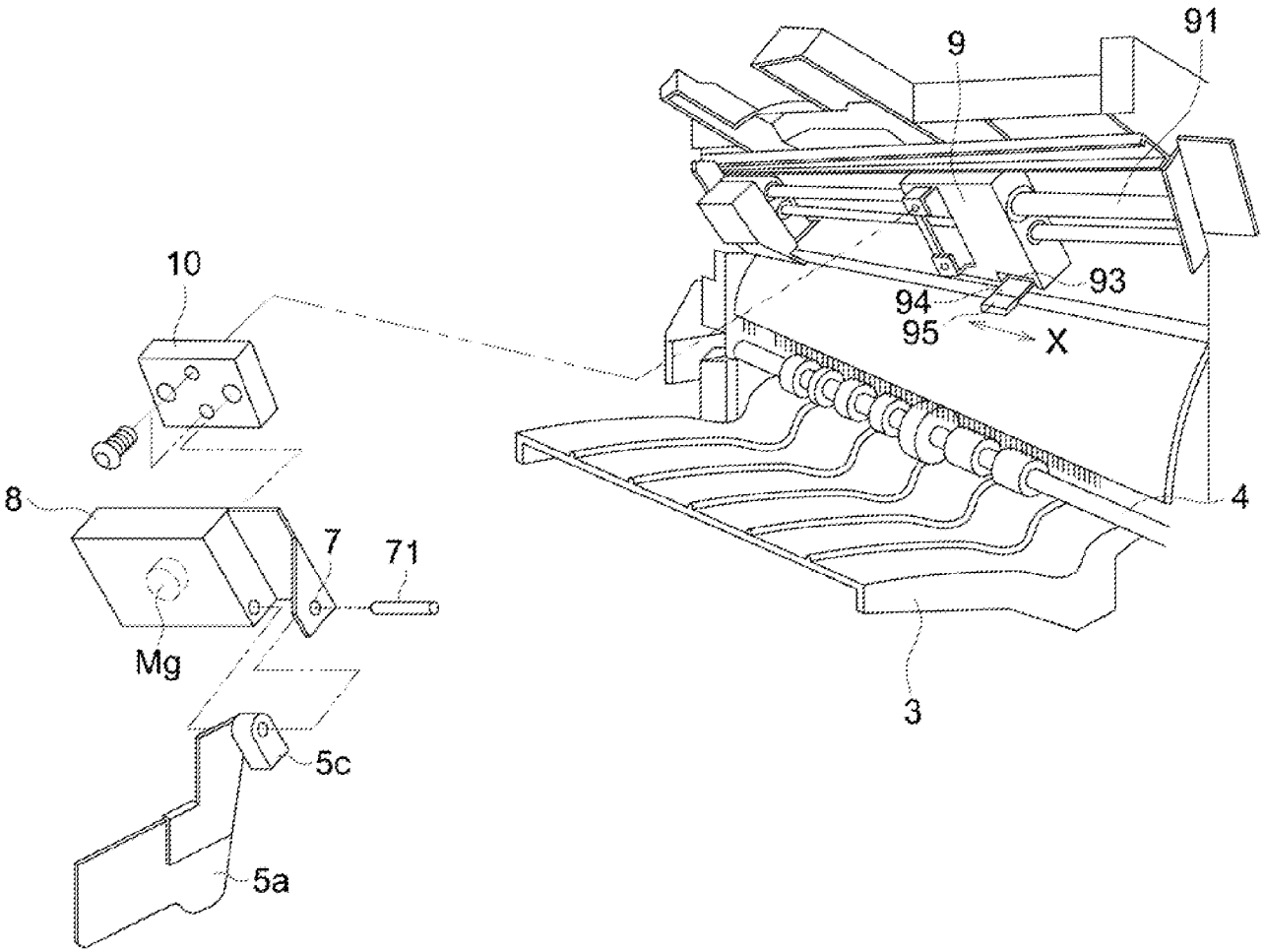
FIG. 10 is a perspective view showing another rotation driving section.

As shown in FIG. 10, the push-out member 94 is provided so as to pass through a slit hole 93 (an elongated hole with a size of 3×15 mm in the present embodiment) of a sliding stand 9. The push-out member 94 is arranged at a position where the push-out member 94 comes in contact with a contact portion 5*c* of the sheet aligning member 5*a* and an elastic member 95 such as rubber is attached to the contact side of the push-out member 94 to be brought in contact with the sheet aligning member 5*a*.

Figure 11:
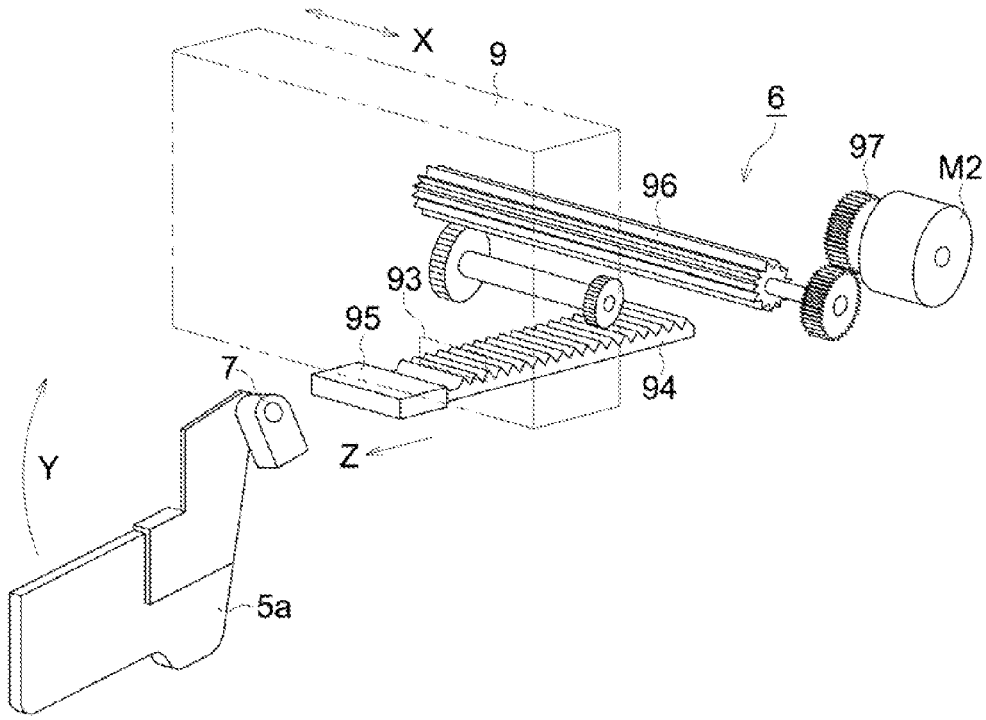
FIG. 11 is an illustration showing a rack-and-pinion section of another rotation driving section.

As shown in FIG. 11, the side of the push-out member 94 opposite to the contact side is provided with a rack (gear).

Further, a pinion shaft 96 is attached such that a pinion gear formed on the pinion shaft 96 engages with the rack, and the pinion shaft 96 is adapted to be rotated by a motor M2 via a gear train 97. Here, the pinion gear on the pinion shaft 96 has a length corresponding to a distance along which the sliding stand 9 shifts in the direction of an arrow X.

When the pinion shaft is rotated, the push-out member is shifted linearly in the direction of an arrow Z. Subsequently, when the push-out member is shifted in the direction of an arrow Z and comes in contact with the sheet aligning member 5*a*, the sheet aligning member 5*a* is rotated upward around the rotation center 7. On the other hand, when the motor M2 rotates in the reverse direction to the push-out direction of the push-out member 94, the push-out member 94 is shifted to the reverse direction to the direction of the arrow Z and the sheet aligning member 5*a* is rotated downward by its gravity. At this time, a spring may be employed to urge the sheet aligning member 5*a* downward without only dependence to the gravity.

Figure 12:
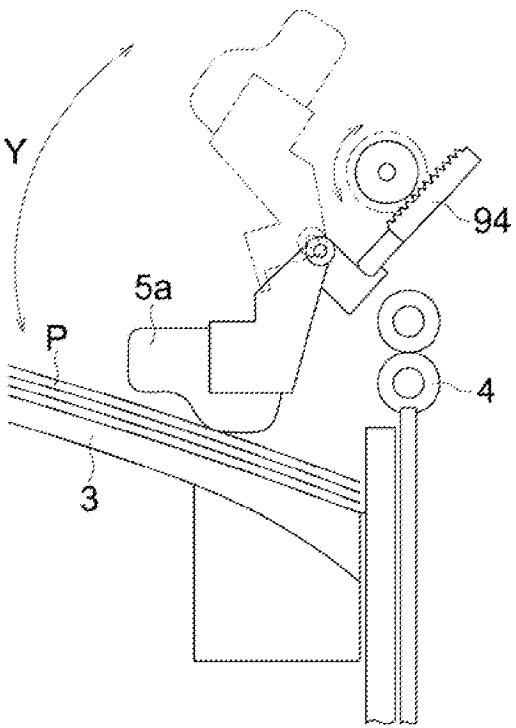
FIG. 12(*a*) is an illustration showing the situation that a sheet aligning member of another rotation driving sections locates at the third position P3 and comes in contact with a sheet P.
Figure 12:
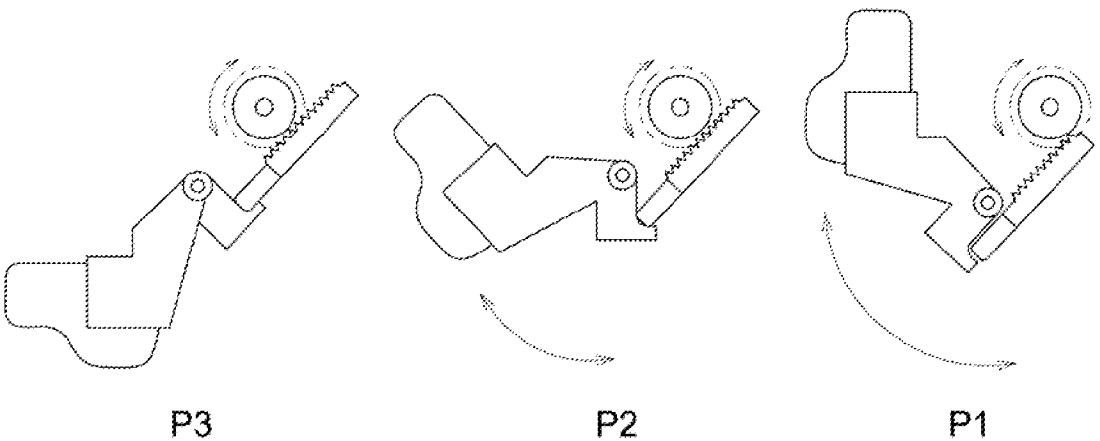

FIG. 12(*a*) is an illustration showing the situation that the sheet aligning member 5*a* is located at the third position P3 and comes in contact with sheets P. FIG. 12(*b*) is an illustration showing the situations that the sheet aligning member 5*a* is rotated by the push-out member 94 and is located the first position P1, the second position P2, and the third position P3 respectively.

In this way, the sheet aligning apparatus 1 of the present invention stops the pair of sheet aligning members 5 at the first position P1 when not conducting an operation to align sheets, stops it at the second position P2 when the sorting section to sort sheets shifts by a predetermined distance, and stops it at the third position P3 when conducting the operation to align sheets. With this structure, when the operation to align sheets is not conducted, since the pair of sheet aligning members 5 is waiting at the first position P1, the pair of sheet aligning members 5 does not interfere an operation to take out sheets stacked on the tray 3. Further, when a sorting operation is conducted continuously, the pair of sheet aligning members 5 is waiting at the second position P2. Therefore, since the pair of sheet aligning members 5 is shifted by only a retracting distance necessary for the sorting operation, a time period until the aligning operation is started can be shortened in comparison with the conventional aligning technique with two stop positions of upper and lower levels.

Consequently, when the operation to align sheets is conducted, since the time period necessary for shifting the pair of sheet aligning members is shortened, sheets can be aligned without the reduction of the number of sheets discharged per hour (the productivity of the image forming apparatus).

What is claimed is:

1. A sheet aligning apparatus comprising:

a discharging section to discharge sheets;

a tray on which the sheets discharged from the discharging section are stacked;

a sorting section to sort the sheets to be stacked on the tray in a direction perpendicular to the discharging direction of the sheets;

a pair of sheet aligning members to align both edges of the sheets sorted and stacked on the tray, wherein the both edges of sheets are located in a direction perpendicular to the conveying direction of the sheets;

a control section to control the pair of sheet aligning members to stop at least three positions in a vertical direction in such a way that:

when a sheet aligning operation is not conducted, the pair of sheet aligning members stops at the first position of an upper level so as not to come in contact with sheets discharged from the discharging section, when the sorting section shifts for sorting sheets, the pair of sheet aligning members stops at the second position of a middle level lower than the first position so as not to come in contact with sheets stacked on the tray, and when a sheet aligning operation is conducted, the pair of sheet aligning members stops at the third position of a lower level so as to come in contact with the top surface of the tray or the upper surface of sheets stacked on the tray.

2. The sheet aligning apparatus described in claim 1, wherein the pair of sheet aligning members is rotated upward and downward around a fixed shaft as a center of rotation.

3. The sheet aligning apparatus described in claim 1, wherein the pair of sheet aligning members is shifted in conjunction with the shifting action of the sorting section.

4. The sheet aligning apparatus described in claim 1, wherein one of the pair of sheet aligning members is fixed and another one is oscillated in a direction perpendicular to the discharging direction of sheets so as to come in contact with edges of sheets and to align the sheets.

5. The sheet aligning apparatus described in claim 4, wherein the pair of sheet aligning members is controlled to change over alternately to act as the fixed sheet aligning member and to act as the oscillated sheet aligning member for every set of sorted sheets.

6. The sheet aligning apparatus described in claim 1, wherein the sorting section comprises a receiving section to receive sheets in a predetermined receiving direction and a sorting box in which the received sheets are stacked.

7. The sheet aligning apparatus described in claim 6, wherein when a set of the predetermined number of sheets are stacked in the sorting box, the sorting section shifts the sorting box by a predetermined distance in the direction perpendicular to the receiving direction.

8. The sheet aligning apparatus described in claim 7, wherein the sorting section sorts sheets by shifting the sorting box such that a preceding set of sheets and the following set of sheets are placed at respective different positions on the tray.

9. The sheet aligning apparatus described in claim 7, wherein the control section shifts the pair of sheet aligning members on the second position in conjunction with the sorting box.

10. The sheet aligning apparatus described in claim 9, wherein the control section rotates and shifts the pair of sheet aligning members from the second position to the third position, thereafter, the control section controls the discharging section to discharge sheets from the sorting box to the tray.

* * * * *